US008544371B2

(12) United States Patent
Lin

(10) Patent No.: US 8,544,371 B2
(45) Date of Patent: Oct. 1, 2013

(54) PAPERBOARD SLITTER MACHINE

(76) Inventor: Tzu-Che Lin, Taipei Hsien (TW)

( * ) Notice: Subject to any disclaimer, the term of this patent is extended or adjusted under 35 U.S.C. 154(b) by 396 days.

(21) Appl. No.: 12/897,193

(22) Filed: Oct. 4, 2010

(65) Prior Publication Data

US 2012/0079932 A1 Apr. 5, 2012

(51) Int. Cl.
*B26D 7/01* (2006.01)

(52) U.S. Cl.
USPC ..... 83/425; 83/101; 83/302; 83/469

(58) Field of Classification Search
USPC ..... 83/879, 883–887, 101, 284, 302, 83/331, 422, 425, 425.3, 435.17, 435.19, 83/435.25, 431, 436.3, 450, 439, 440, 440.1, 83/469, 483, 495; 144/250.13, 250.15
See application file for complete search history.

(56) References Cited

U.S. PATENT DOCUMENTS 2,679,871 A * 6/1954 Ford ..... 144/250.13
3,738,403 A * 6/1973 Schwoch et al. ..... 144/250.15
3,752,021 A * 8/1973 Klien et al. ..... 409/304
4,469,318 A * 9/1984 Slavic ..... 269/91
4,696,392 A * 9/1987 Chisholm, Jr. ..... 198/836.2

* cited by examiner

*Primary Examiner* — Phong Nguyen
(74) *Attorney, Agent, or Firm* — Muncy, Geissler, Olds & Lowe, PLLC

(57) ABSTRACT

A paperboard slitter machine includes a first housing, a rotary cutter movable in and out of the first housing for cutting a paperboard, a second housing, a passage defined between the first housing and the second housing for the feeding of the paperboard to be cut, a linking mechanism holding two roller brushes in the second housing and a driving device controllable to move the linking mechanism in carrying the roller brushes out of the second housing into the passage to press on the paperboard at two sides relative to the rotary cutter for enabling the paperboard to be accurately and smoothly cut by the rotary cutter.

4 Claims, 4 Drawing Sheets

PAPERBOARD SLITTER MACHINE

BACKGROUND OF THE INVENTION

1. Field of the Invention

The present invention relates to a paperboard cutting technology and more particularly, to a paperboard slitter machine, which utilizes a linking mechanism to carry roller brushes in and out of a paperboard feeding passage so that when a rotary cutter is moved to cut a paperboard, the roller brushes are pressed on the paperboard at two sides relative to the rotary cutter for enabling the paperboard to be accurately and smoothly cut by the rotary cutter.

2. Description of the Related Art

Following the rise in living standards and the consciousness of environmental protection, using a paper material to pack products has become a popularly accepted trend. For the advantages of light in weight, shock absorbness, colorful printing and high durability, corrugated paperboard is intensively used for making cartons and paper boxes for packing different products, avoiding product damage during transportation.

When making a corrugated paperboard, a strip of paperboard is corrugated by heated, fluted rolls, and then the protruding tips on one side of the fluted paperboard strip are coated with an adhesive, and then a flat sheet of facing paperboard is positioned in contact with the tips, and then heat and pressure are applied as the fluted strip and facing board are held together to complete the bond. To fit different requirements, a big size corrugated paperboard is made and then properly cut through a paperboard slitter machine into the desired size or sizes. FIG. 4 illustrates a paperboard slitter machine according to the prior art. According to this design, the paperboard slitter machine comprises a bottom machine frame unit A, a top machine frame unit B spaced above the bottom machine frame unit A, a passage B1 defined between the bottom machine frame unit A and the top machine frame unit B, a rotary cutter A1 mounted in the bottom machine frame unit A and adapted for cutting a paperboard C that is being fed through an entrance B11 into the passage B1, and a roller brush B2 mounted in the top machine frame unit B and suspending in the passage B1 to press the paperboard C being delivered through the passage B1 for cutting.

The aforesaid prior art paperboard slitter machine is still not satisfactory in function and has the drawbacks as follows:

1. The paperboard C will be cut by the rotary cutter A1 after having been pressed by the roller brush B2. When the lead end of the paperboard C passed over the roller brush B2 and is cut by the rotary cutter A1, rotary cutter A1 will give an upward pressure to the lead end of the paperboard C during cutting, causing an incomplete cutting. A further checking by labor is necessary. When an incomplete cutting occurs, a further manual cutting step must be performed, increasing the cost.
2. When the lead end of the paperboard C is lifted during cutting, the roller brush B2 is kept pressed on the tail end of the paperboard C, causing formation of a dent or bending trace on the paperboard C. In consequence, the defective rate will be increased.

Therefore, it is desirable to provide a paperboard slitter machine, which eliminates the aforesaid problems.

SUMMARY OF THE INVENTION

The present invention has been accomplished under the circumstances in view. It is therefore the main object of the present invention to provide a paperboard slitter machine, which facilitates accurate cutting of each fed paperboard without causing damage to the paperboard, thereby increasing the yield. It is another object of the present invention to provide a paperboard slitter machine, which assures accurate cutting, avoiding damage to the machine parts and saving much machine parts maintenance labor and cost.

To achieve these and other objects of the present invention, a paperboard slitter machine comprises a first housing having defined therein an accommodation chamber, a second housing, a passage defined between the first housing and the second housing for the passing of a paperboard, a rotary cutter mounted in the accommodation chamber inside the first housing and movable out of the accommodation chamber into the passage to cut the paperboard being delivered through the passage, and a linking mechanism mounted in the second housing. The linking mechanism comprises at least one roller brush holder arm mounted in the second housing, two roller brushes pivotally mounted on the at least one roller brush holder arm, and a driving device controllable to move the at least one roller brush holder arm between a first position where the roller brushes are held in the passage at two sides relative to the rotary cutter to press the fed paperboard in the passage for cutting by the rotary cutter and a second position where the roller brushes are kept away from the passage and received inside the second housing.

Further, a space is left between the two roller brush holder arms for receiving the rotary cutter during cutting. When the rotary cutter is moved out of the first housing to cut the paperboard, the two roller brushes are pressed on the paperboard against the first housing at two opposite lateral sides relative to the rotary cutter, and therefore the paperboard will not be curved or deformed during cutting and will be accurately cut, avoiding any further supplementary manual cutting step.

The space left between the two roller brushes is adapted for receiving the rotary cutter when the rotary cutter is being moved out of the first housing to cut the paperboard, avoiding accidental damage to the roller brushes by the rotary cutter and saving much roller brush maintenance and replacement labor and time.

Further, by means of controlling the driving device to move one roller brush holder arm of the linking mechanism, the two roller brush holder arms are moved synchronously to carry the two roller brushes to one same plane, keeping the two roller brushes in balance when the two roller brushes are pressed on the paperboard against the platform of the first housing, and therefore the two roller brushes impart an equal amount of pressure to the paperboard, avoiding damage and increasing the yield.

In one embodiment of the present invention, two substantially L-shaped roller brush holder arms of the linking mechanism are pivotally mounted in the second housing and coupled together by the link for synchronous rotary motion. By means of biasing the roller brush holder arms to carry the roller brushes in and out of the passage in a swinging motion, the total height of the second housing is minimized, and therefore the machine size can be minimized.

DETAILED DESCRIPTION OF THE PREFERRED EMBODIMENT

Figure 1:
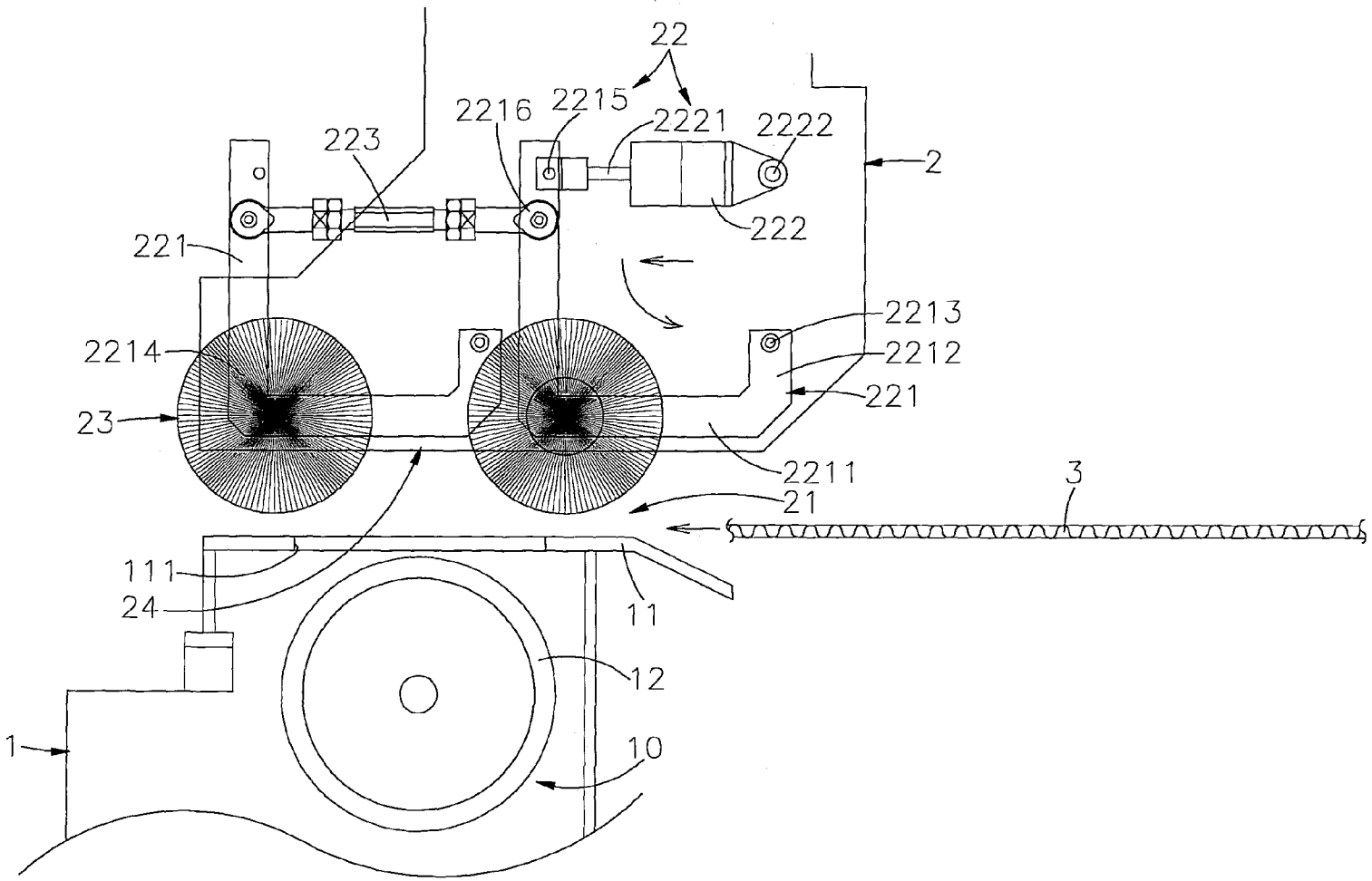
FIG. 1 is a schematic side view of a paperboard slitter machine in accordance with a first embodiment of the present invention
Figure 2:
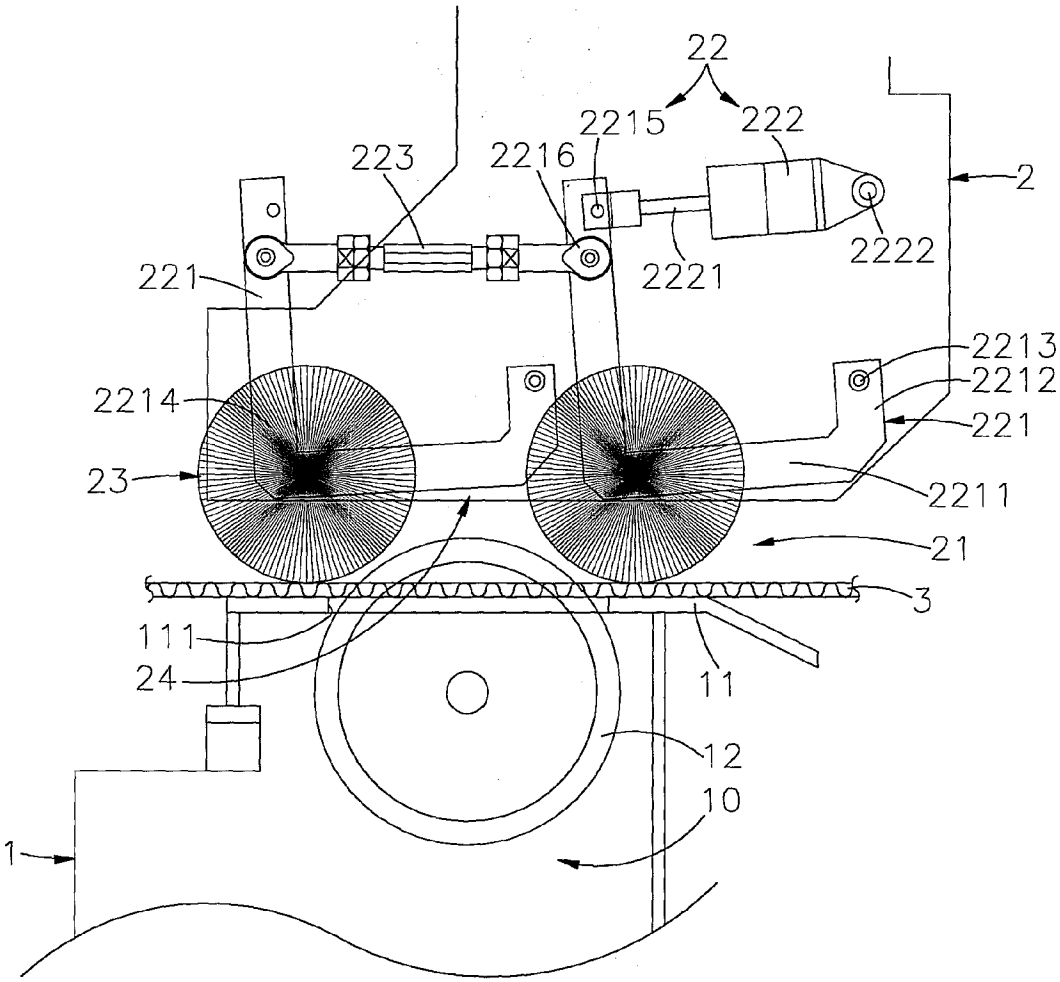
FIG. 2 is a schematic side view of the first embodiment of the present invention, illustrating the paperboard slitter machine in a cutting operation.

Referring to FIGS. 1 and 2, a paperboard slitter machine in accordance with the present invention is shown comprising a first housing 1 and a second housing 2.

The first housing 1 comprises an accommodation chamber 10, a platform 11 located on one side relative to the accommodation chamber 10 for bearing a paperboard 3 for cutting, and a cutter slot 111 cut through the platform 11 and disposed in communication with the accommodation chamber 10 and the outside space. Further, a rotary cutter 12 is pivotally mounted in the accommodation chamber 10 and partially movable in and out of the cutter slot 111 to cut the paperboard 3 that is being transferred over the platform 11.

The second housing 2 is disposed at one side relative to the platform 11 of the first housing 1 in such a manner that a passage 21 is defined between the platform 11 of the first housing 1 and the second housing 2 for the passing of a paperboard 3 for cutting. The second housing 2 houses a linking mechanism 22 having at least one, for example, two roller brush holder arms 221, two roller brushes 23 respectively pivotally mounted on the two roller brush holder arms 221 adjacent to the passage 21, and a driving device 222 connected to the linking mechanism 22 at a location far from the passage 21 and adapted for moving the roller brush holder arms 221. The two roller brushes 23, i.e., the two roller brush holder arms 221 are spaced from each other by a space 24 that is provided for receiving the rotary cutter 12 when the rotary cutter 12 protrudes over the cutter slot 111 to cut the paperboard 3 being transferred over the platform 11. Therefore, the rotary cutter 12 does not touch the roller brushes 23 during cutting. Further, each roller brush 23 has multiple bundles of tough bristles densely fastened to the periphery of the core shaft thereof.

Referring to FIGS. 1 and 2 again, the roller brush holder arms 221 of the linking mechanism 22 have a substantially L-shaped profile. Each roller brush holder arm 221 has an elongated base arm portion 2211, an end portion 2212 extended from one end of the elongated base arm portion 2211 at a predetermined angle, a first pivot 2213 pivotally connect the end portion 2212 to the second housing 2 for enabling the respective roller brush holder arm 221 to be turned back and forth about the first pivot 2213 within a predetermined angle to carry the associating roller brush 23 into or out of the passage 21, an elongated actuation arm portion 2214 perpendicularly extended from the other end of the elongated base arm portion 2211, a second pivot 2215 pivotally connect the distal end of the elongated actuation arm portion 2214 to the driving device 222 and a connection portion 2216 fixedly located on the elongated actuation arm portion 2214 between the second pivot 2215 and the elongated base arm portion 2211. The linking mechanism 22 further comprises a link 223 coupled between the connection portions 2216 of the two roller brush holder arms 221. Further, the driving device 222 is pivotally connected to the second housing 2 by a pivot member 2222, having a reciprocating rod 2221 connected to the second pivot 2215 at one roller brush holder arm 221. Further, the roller brushes 23 are respectively pivotally mounted on the elongated actuation arm portions 2214 of the roller brush holder arms 221 adjacent to the associating elongated base arm portions 2211.

When a paperboard 3 is being delivered through the passage 21 between the first housing 1 and the second housing 2, the rotary cutter 12 is moved out of the cutter slot 111 to cut the paperboard 3, and the same time the driving device 222 is controlled to extend out the reciprocating rod 2221, moving the elongated actuation arm portion 2214 of the respective roller brush holder arm 221 in one direction. At this time, the end portion 2212 of the respective roller brush holder arm 221 is forced to turn about the respective first pivot 2213 in one direction, and therefore the associating roller brush 23 is moved into the passage 21 to press the paperboard 3 on the platform 11 of the first housing 1 for cutting by the rotary cutter 12 accurately. Subject to the linking effect of the link 223 that is coupled between the connection portions 2216 of the two roller brush holder arms 221, the two roller brush holder arms 221 are moved synchronously, and therefore the two roller brushes 23 are simultaneously moved into the passage 21 to press the paperboard 3 on the platform 11 of the first housing 1, keeping the paperboard 3 is smooth condition for cutting by the rotary cutter 12 accurately. Therefore, the paperboard 3 will not be curved or deformed during cutting, i.e., the invention facilitates accurate paperboard cutting, saving much the cutting cost and increasing the yield.

After cutting, the rotary cutter 12 is moved backwards to the inside of the accommodation chamber 10, and the driving device 222 is controlled to move back the reciprocating rod 2221, and therefore the roller brush holder arms 221 and the roller brushes 23 are returned to their former positions.

Further, the first housing 1 can be set at the bottom side, and the second housing 2 can be set at the top side. Alternatively, the position of the first housing 1 and the position of the second housing 2 can be exchanged, enabling the paperboard 3 to be closely attached to the platform 11 of the first housing 1 for cutting by the rotary cutter 12.

Figure 3:
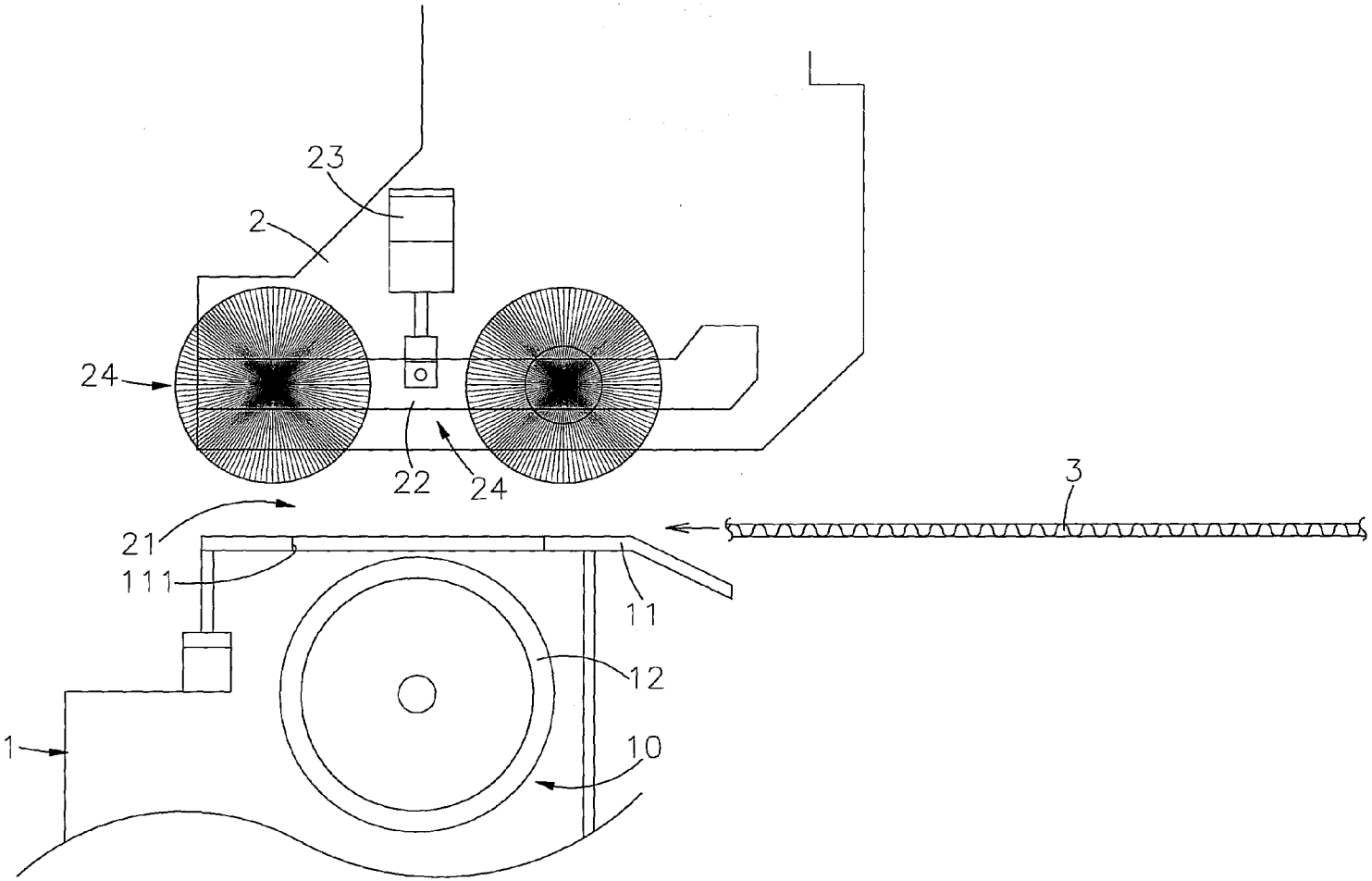
FIG. 3 is a schematic side view of a paperboard slitter machine in accordance with a second embodiment of the present invention.
Figure 4:
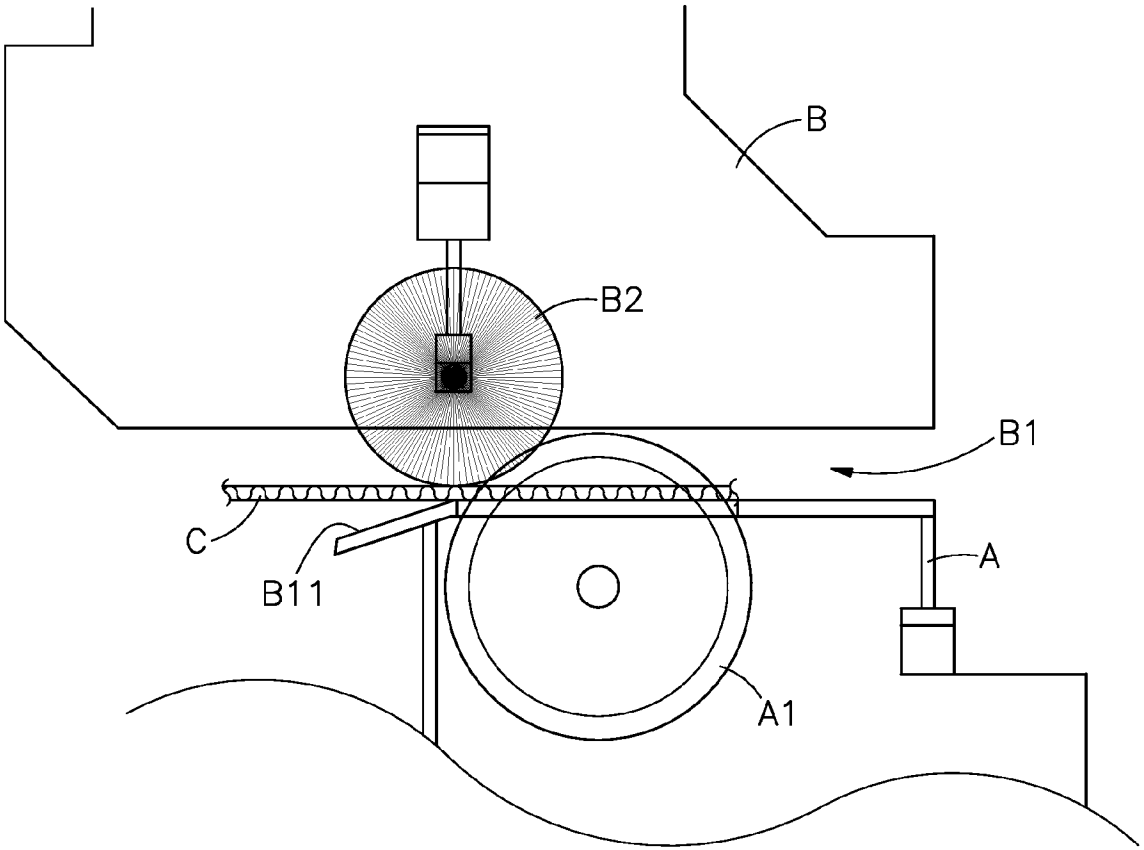
PRIOR ART FIG. 4
FIG. 4 is a side view of a paperboard slitter machine according to the prior art.

FIG. 3 illustrates an alternate form of the present invention. According to this alternate form, the driving device, referenced by 23, is fixedly mounted in the second housing 2 in vertical and controllable to move the linking mechanism 22 up and down between the operative position where the roller brushes 23 that are carried on the linking mechanism 22 are moved into the passage 21 and pressed on the fed paperboard 3 against the platform 11 of the first housing 1 for enabling the paperboard 3 to be accurately cut by the rotary cutter 12 and the non-operative position where the roller brushed 23 are moved away from the passage 21. According to this alternate form, the vertical height of the path required for the roller brushes 23 is relatively longer than the swinging motion in the embodiment of FIGS. 1 and 2, i.e., the height of the second housing 2 in accordance with the embodiment of FIGS. 1 and 2 can be shorter than that in accordance with the embodiment of FIG. 3.

Further, the aforesaid driving device 23 can be an air cylinder, hydraulic cylinder or any of a variety of other means capable of moving the reciprocating rod 2221 linearly back and forth between an extended position and a received position.

In conclusion, the invention provides a paperboard slitter machine, which has advantages and features as follows:

1. Subject to the arrangement of the space 24 between the two roller brush holder arms 221 for receiving the rotary cutter 12 during cutting, the two roller brushes 23 are pressed on the paperboard 3 against the platform 11 of the first housing 1 at two opposite lateral sides relative to the rotary cutter 12 which is being moved out of the cutter slot 111 to cut the paperboard 3, and therefore the paperboard 3 will not be curved or deformed during cutting and will be accurately cut, avoiding any further supplementary manual cutting step.

2. During cutting, the two roller brushes 23 are pressed on the paperboard 3 against the platform 11 of the first housing 1 at two opposite lateral sides relative to the cutting position, and therefore the paperboard 3 will not be curved or deformed during cutting, increasing the yield.

3. The space 24 left between the two roller brush holder arms 221 is adapted for receiving the rotary cutter 12 when the rotary cutter 12 protrudes over the cutter slot 111 to cut the paperboard 3 being transferred over the platform 11, avoiding accidental damage to the roller brushes 23 by the rotary cutter 12 and saving much roller brush maintenance and replacement labor and time.

4. By means of controlling the driving device 222 to move one roller brush holder arm 221 of the linking mechanism 22, the two roller brush holder arms 221 are moved synchronously to carry the two roller brushes 23 to one same plane, keeping the two roller brushes 23 in balance when the two roller brushes 23 are pressed on the paperboard 3 against the platform 11 of the first housing 1, and therefore the two roller brushes 23 impart an equal amount of pressure to the paperboard 3, avoiding damage and increasing the yield.

5. The roller brush holder arms 221 of the linking mechanism 22 are pivotally mounted in the second housing 2 and coupled together by the link 223 for synchronous rotary motion. By means of biasing the roller brush holder arms 221 to carry the roller brushes 23 in and out of the passage 21 in a swinging motion, the total height of the second housing 2 is minimized, and therefore the machine size can be minimized.

In general, the invention provides a paperboard slitter machine, which comprises a first housing 1, a rotary cutter 12 mounted in the first housing 1 and movable in and out of the first housing 1 for cutting a paperboard 3, a second housing 2 kept apart from the first housing 1 such that a passage 21 is defined between the first housing 1 and the second housing 2 for the passing of the paperboard 3 to be cut, a linking mechanism 22 having two roller brush holder arms 221 pivotally mounted in the second housing 2 and connected in parallel by a link 223 and a driving device 222 controllable to bias the roller brush holder arms 221, and two roller brushes 23 respectively pivotally mounted on the roller brush holder arms 221 and movable by the roller brush holder arms 221 in and out of the passage 21 for holding down the fed paperboard 3 on the first housing 1 for cutting by the rotary cutter 12 accurately and smoothly.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A paperboard slitter machine, comprising:

a first housing having defined therein an accommodation chamber;

a second housing;

a passage defined between said first housing and said second housing for the passing of a paperboard;

a rotary cutter mounted in said accommodation chamber inside said first housing and movable out of said accommodation chamber into said passage to cut the paperboard being delivered through said passage; and a linking mechanism mounted in said second housing, said linking mechanism comprising at least one roller brush holder arm, a plurality of roller brushes pivotally mounted on said at least one roller brush holder arm, and a driving device controllable to move said at least one roller brush holder arm between a first position where said roller brushes are held in said passage at two sides relative to said rotary cutter to press the fed paperboard in said passage for cutting by said rotary cutter and a second position where said roller brushes are kept away from said passage and received inside said second housing, wherein said linking mechanism comprises a plurality of roller brush holder arms respectively pivotally mounted in said second housing, and at least one link coupled to said roller brush holder arms to connect said roller brush holder arms in parallel, each said roller brush holder arm compromising an elongated base arm portion, an end portion extended from one end of said elongated base arm portion at predetermined angle, a first pivot pivotally connect said end portion to said second housing for enabling the respective roller brush holder arm to be turned back and forth about said first pivot between said first position and said second position by said driving device, an elongated actuation arm portion perpendicularly extended from an opposite end of said elongated base arms portion, a second pivot pivotally connect a distal end of said elongated actuation arm portion to said driving device; said roller brushes are respectively pivotally mounted the elongated actuation arm portions of said roller brush holder arms adjacent to the respective elongated base arm portions, and wherein said driving device comprises a reciprocating rod coupled to the second pivot of one said roller brush holder arm and movable between an extended position and a received position to bias said roller brush holder arms between said first position and said second position.

2. The paperboard slitter machine as claimed in claim 1, wherein said first housing comprises a platform located on one side of said accommodation housing and facing said passage, and a cutter slot cut through said platform for the passing of said rotary cutter in and out of said passage.

3. The paperboard slitter machine as claimed in claim 1, wherein each said brush roller comprises multiple bundles of tough bristles evenly fastened to the periphery thereof.

4. The paperboard slitter machine as claimed in claim 1, wherein said driving device comprises a reciprocating rod connected to said at least one roller brush holder arm and movable between an extended position and a received position in direction perpendicular to said passage to move said at least one roller brush holder arm linearly between said first position and said second position.

* * * * *